United States Patent [19]

Büchl

[11] Patent Number: 4,544,986

[45] Date of Patent: Oct. 1, 1985

[54] METHOD OF ACTIVATING AN ELECTROMAGNETIC POSITIONING MEANS AND APPARATUS FOR CARRYING OUT THE METHOD

[76] Inventor: Josef Büchl, Rehsteig 12, D-8071 Lentig, Fed. Rep. of Germany

[21] Appl. No.: 586,030

[22] Filed: Mar. 5, 1984

[30] Foreign Application Priority Data

Mar. 4, 1983 [DE] Fed. Rep. of Germany ..... 3307683

[51] Int. Cl.[4] ..... H01H 47/32

[52] U.S. Cl. ..... 361/152; 123/90.11; 361/210

[58] Field of Search ..... 361/152, 167, 203, 210; 123/90.11; 251/129, 137, 141

[56] References Cited

U.S. PATENT DOCUMENTS 3,147,406 9/1964 Kotos ..... 361/203 X
3,870,931 3/1975 Myers ..... 361/210 X
3,882,833 5/1975 Longstaff et al. ..... 123/90.11
4,432,033 2/1984 Brundage ..... 361/210

*Primary Examiner*—Harry E. Moose, Jr.
*Attorney, Agent, or Firm*—Karl Hormann

[57] ABSTRACT

A method of and an apparatus for activating an electromagnetic positioning means or actuator of the kind sometimes known as an electrical cam with relatively low currents, by alternately energizing, or energizing with currents of opposite polarity, two electromagnets to move an armature positioned therebetween between two terminal positions. The device is activated from an inactive or passive to an active state by energizing currents having at least initially a frequency greater than the resonant frequency of the positioning means. With increasing oscillations of the armature the frequency of the energizing current is reduced to zero as the device reaches its fully activated state, i.e. when the armature has oscillated in a step-like manner to one of its terminal positions. The device may be have utility for driving gas exchange valves of internal combustion engines.

13 Claims, 3 Drawing Figures

METHOD OF ACTIVATING AN ELECTROMAGNETIC POSITIONING MEANS AND APPARATUS FOR CARRYING OUT THE METHOD

BACKGROUND OF THE INVENTION

1. Field of the Invention

The invention relates generally to electromagnetic positioning means or actuators. More particularly, it relates to a novel method of activating an electromagnetic actuator and to an apparatus or system for carrying out the method.

In the context of this invention, an electromagnetic actuator is understood to mean a device which comprises a positioning member which in its passive or inactive condition assumes a rest position under the bias of two counteracting springs, between first and second terminal positions. Affixed to the positioning member is an armature which is movable by two electromagnets. The armature, together with the positioning member and the two springs, comprises a vibratory or oscillatory system in the nature of an electrical cam. It may be moved into the first terminal position by one of the electromagnets against the bias of one of the springs, and it may be moved into the second terminal position, against the bias of the other spring, by the other electromagnet.

2. Description of the Prior Art

German published Patent Specification No. P 26 30 512 teaches an electromagnetic actuator of the kind here under consideration. That is to say, the actuator comprises a positioning member which when in its inactive condition assumes a rest position intermediate first and second terminal positions, and it is maintained in this rest position by the bias of two counteracting springs. Affixed to the positioning member is a magnetizable armature which cooperates with two electromagnets for moving the positioning member between its first and second terminal positions. Hence, the armature, together with the positioning member and the two springs, constitutes a vibratory or oscillatory system. It is movable into its first and second terminal positions, respectively, against the bias of one or other of the springs, by energizing the appropriate one of the electromagnets. The electromagnets are provided with appropriate abutment faces. Nothing is said in the specification in respect of the manner in which the device is switched from its inactive condition in which the armature rests intermediate the electromagnets, into its activated condition in which the armature would be in engagement with one of the electromagnets. Activation by energizing one of the electromagnets requires currents of considerable strength, for on the one hand there exists quite a large gap between the armature and the electromagnet before its energization, and on the other hand the force of the associated spring has to be overcome.

For activating such a positioning means there is disclosed in German published Patent Specification DE-OS No. P 30 24 109 a cocking or winding device by means of which the locus of the rest position may by changed in such a manner that the armature connected to the positioning member is moved into engagement with one of the electromagnets so that the positioning member upon activating the electromagnet remains in engagement therewith when the cocking device is turned off. With the armature in engagement with one of the electromagnets the actuator is in an activated state and can only be moved into its terminal positions by energization of the electromagnets. The cocking or winding device disclosed in the specification requires considerable space and significantly adds to the cost of the device.

German published Patent Specification DE-OS No. P 28 15 849 relates to an electromagnetic valve control means for internal combustion engines. The control means is provided with a single electromagnet which in its energized state attracts the armature connected to a valve member, thus moving the valve into its open condition, against the force of a closing spring. For energizing the electromagnet, means is provided for generating a square wave voltage signal. As will be apparent to those skilled in the art, relatively strong currents and considerable electrical energy are required in such valve controls to generate the force necessary for opening the valve.

SUMMARY OF THE INVENTION

It is an object of the invention to provide a method of activating an electromagnetic positioning means of simple construction in a reliable manner.

Another object of the invention resides in the provision of a method of activating an electromagnetic positioning means with relatively low currents.

It is also an object of the invention to provide an apparatus or system which permits carrying out the method in accordance with the invention.

Furthermore, it is an object of the invention to provide electronic circuitry by means of which an electromagnetic positioning means may be activated at low currents.

A further object of the invention resides in providing a method of activating an electromagnetic positioning means at frequencies related to its resonant frequency.

Yet another object lies in the provision of a novel method of activating an electromagnetic positioning means in such a manner that it oscillatingly or vibratorily swings from its inactive to its active condition.

In accomplishing these and other objects, there is provided a method of activating an electromagnetic positioning means or actuator comprising a positioning member which in its inactive state is biased into a rest position between first and second terminal positions by the force of a pair of counteracting springs. Affixed to the positioning member is a magnetizable armature which in the inactive state of the device is positioned substantially half-way between first and second electromagnets. The armature, the positioning member, and the springs constitute an oscillatory or vibratory system which may be activated by energizing the electromagnets, to move to the first and second terminal positions against the force of one or the other of the springs. Specifically, the method provides for energizing the electromagnets in alternating phases at a frequency substantially equal to the resonant frequency of the system, for a time sufficient to move the system to its first and terminal positions in oscillating steps, the energizing frequency at the beginning of the operation being greater than the resonant frequency of the system. Once the system has reached one of the terminal positions the energizing frequency is gradually reduced to zero, and thereafter one of the electromagnets is maintained in a state of energization. Advantageously, the phase utilization ratio of the energizing frequency is substantially 50%, and the phases alternate at substantially 180°. In an advantageous embodiment, the system comprises means for generating a square wave alternating current signal of variable frequency, as well as steering circuit means the output of which activates or energizes the electromagnets in accordance with the signal.

Electromagnetic positioning means of the kind here under consideration may find many different applications. In a preferred embodiment, the invention may find utility in connection with oscillatorily moving control means of internal combustion engines, e.g. gas exchange valves of such engines.

Other objects and further scope of applicability of the present invention will become apparent from the detailed description below, taken together with the accompanying drawings.

Figure 1:
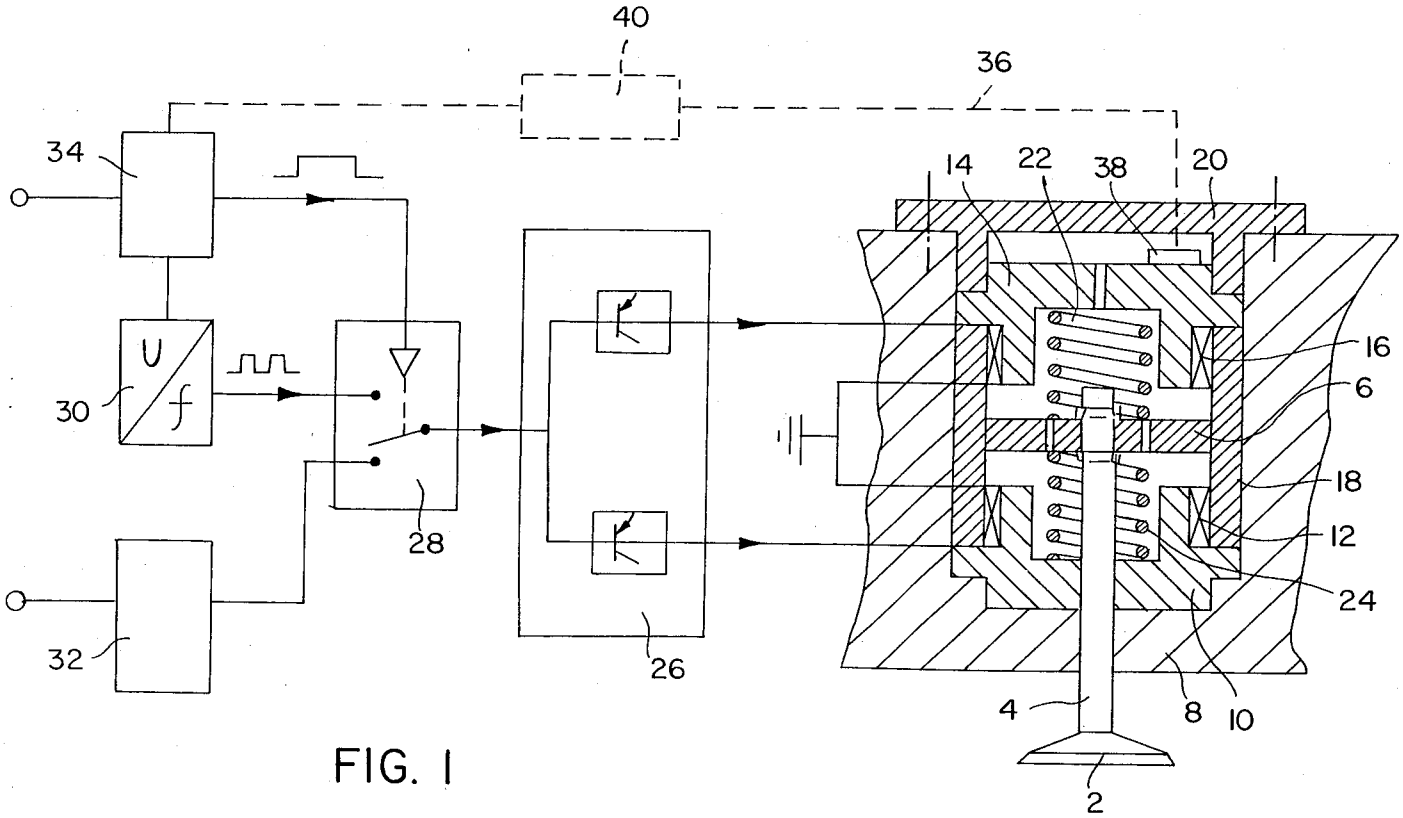
FIG. 1 depicts an electromagnetic positioning means together with a block diagram of a control circuit associated therewith, in accordance with the invention.

The positioning means here under consideration may take many different forms. For instance, it may be a linear motor or a so-called electrical cam. In the embodiment shown in FIG. 1, the positioning means is a poppet valve 2 of the kind used in internal combustion engines to accommodate fuel intake and exhaust emission. The valve 2 is shown to have a stem 4. The stem 4 is mounted for sliding movement within a housing 8 and extends through openings in substantially U-shaped (in longitudinal section) cores 10 and 14 of electromagnets provided at opposite ends of a bore provided in the housing 8. The cores are provided with windings 12 and 16, respectively. The spacing between the electromagnets is defined by a sleeve 18 extending between them. The electromagnets are maintained in their position by a lid or cap nut 20 threaded into, or otherwise sucured to, the housing 8. An armature 6 is affixed to the stem 4 and is positioned between the electromagnets. In its inactive state shown, the armature 6 is biased into a position intermediate the electromagnets by helical springs 22 and 24 extending between the armature 6 and the cores 14 and 10, respectively. The springs may be of equal force.

The helical springs 22 and 24, together with the armature 6 and the valve stem 4 constitute an osciallatory or vibratory system having a resonant frequency greater than the maximum intended frequency for operating the valve 2.

The electromagnets are energized by a steering circuit 26 having two output terminals connected to the windings 12 and 16, respectively. The steering circuit 26 is connected to a voltage-to-frequency converter 30 or to a control circuit 32, depending upon the condition of a switch 28.

The converter 30 is connected to the output terminal of a start or energizing stage 34. A second output of the stage 34 is connected to the switch 28.

A sensor 38 is mounted in the core 14. A line 36 leads from the sensor 38 to a monitoring or evaluation circuit 40 which, in turn, is connected to the start stage 34.

The start stage 34 will be described in detail infra. All other components of the circuit described are well known in the art and, therefore, require no elucidation. The control circuit 32 forms no part of this invention and, hence, will be described only to the extent necessary to explain the invention.

Figure 2:
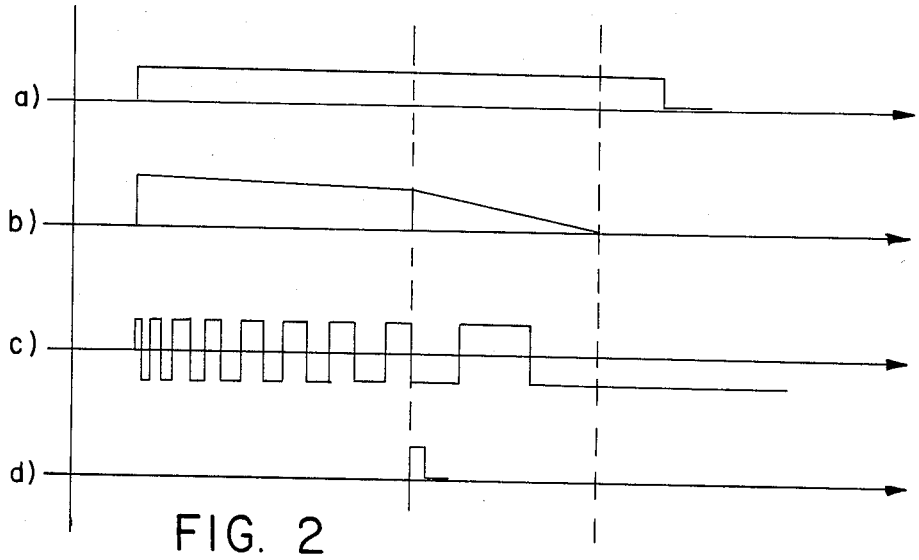
FIG. 2 is a diagram of signals generated in the circuit of FIG. 1.

The operation of the described circuit will now be described with reference to FIG. 2:

Actuation of a start button 42 causes stage 34 to generate a square wave signal as shown at (a) at its output connected directly with the switch 28. At its output terminal connected to the voltage-to-frequency converter 30, the start stage 34 generates a predetermined voltage which will slowly decrease or decay in time.

The converter 34, in turn, generates a square wave signal which has a phase utilization ratio of about 50% and which has a frequency which as shown at (b) is initially greater than the resonant frequency of the valve 2. However, as the voltage decays the frequency gradually decreases to the resonant frequency. As shown at (c) the change in frequency of the square wave signal occurs sufficiently slowly so that when the resonant frequency is reached the valve will have been activated for a time long enough to swing the armature into engagement with one of the cores 10 or 14. Once this engagement occurs the sensor 38 generates a signal which is fed to the monitor circuit 40. The monitor 40, in turn, feeds a signal shown at (d) to the start stage 34. This causes a more rapid decay to zero of the voltage fed to the converter 30. This results in a corresponding accellerated decrease of the square wave signal (c) to zero, so that in the final stage one of the windings 12 or 16 remains in a state of energization.

Once one of the terminal positions has been reached, i.e. once the signal (d) is generated, the armature 6 and, hence, the valve 2 will move in accordance with the energizations of the electromagnets. Therefore, the valve 2 is in an activated state and will always be in a well defined position.

The square wave signal (a) goes to zero slightly after the voltage has decayed to zero. At this point the switch 28 changes its condition to connect to the control circuit 32. Depending on the output signal of the circuit 32 one of the windings 12 or 16 then becomes energized while the other winding is deenergized.

As will be appreciated by those skilled in the art, many changes and modifications may be made to the preferred embodiment of this invention without departing from its scope and spirit. The following few examples of such modifications are illustrative but not intended as limiting:

The armature may be made from permanently magnetic material, or it may be ferromagnetic. In case of the former the polarity of the energization of the electromagnets is important with respect to the force generated. The steering circuit 26 may thus be provided with a control circuit (not shown) by means of which the energization of the electromagnets may be controlled in such a manner that commencing with the core engaged by the armature, the winding may be energized with current of a polarity rejecting the armature 6 while, substantially simultaneously, the other winding may be energized with current of a polarity attracting the armature 6. In connection with an armature of ferromagnetic material it may be advantageous to employ additional controls for the purpose of ensuring a phase alternation of 180° in the flux of the electromagnets as well as in the energizing currents.

In a preferred embodiment the armature 6 will be in intimate contact with one of the cores 10 or 14 when in its activated state. However, since the valve 2 should be in intimate, i.e. sealing contact with a valve seat (not shown) it may be possible or, indeed, desirable, to provide for a small gap between the armature 6 and the core 14 which controls the closed position of the valve 2. Such a gap would, however, significantly increase the current required to retain the valve in its closed state.

The sensor 36, as shown, may be of the kind responsive to mechanical vibrations in the audible frequency range or a higher range. Alternatively it may be an induction coil in one of the input leads of the windings 12 or 16. As soon as the armature contacts either core 10 or 14, the current in the associated winding changes rapidly generating a voltage signal in the induction coil which could be monitored and evaluated by the circuit 40.

Figure 3:
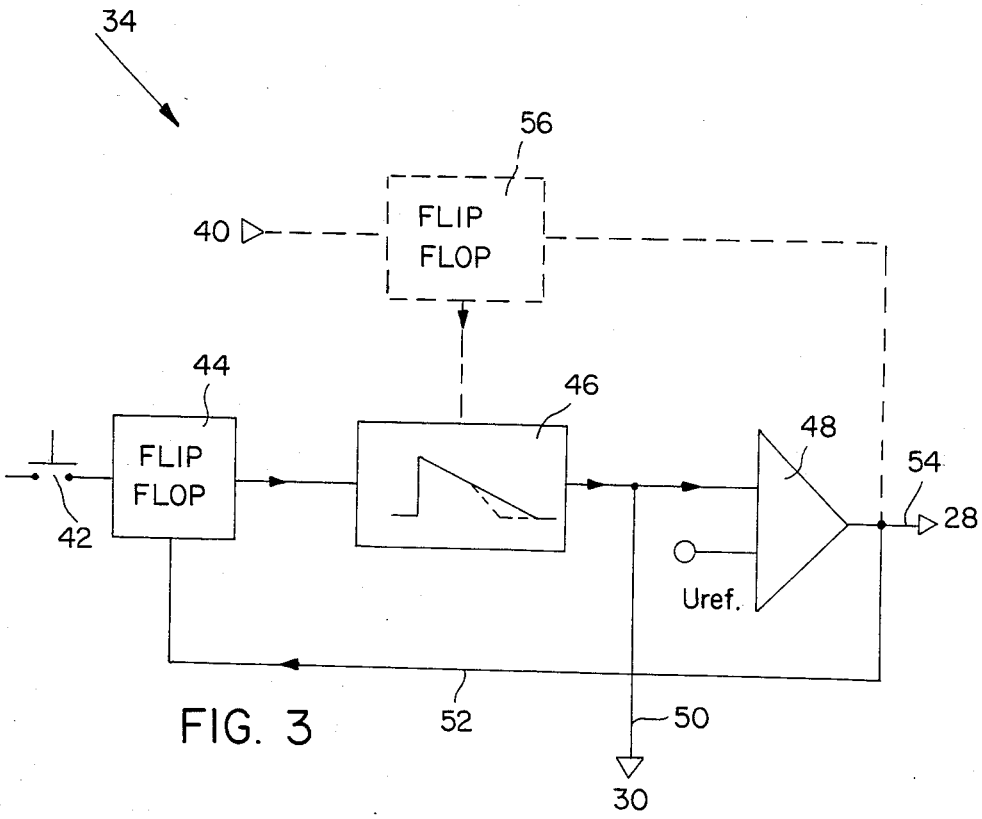
FIG. 3 is a block diagram of a preferred embodiment of the start stage or energizing circuit shown in FIG. 1.

Reference is now made to FIG. 3 to describe a preferred embodiment of the start or energizing stage 34:

A start button 42 to connected to the set terminal of a flip flop 44 the output of which is connected to the input terminal of an integrator 46. The output of the integrator 46 is connected to an input terminal of a comparator 48 and also, by a line 50, to the voltage-to-frequency converter 30. The output of the comparator 48 is connected to the reset terminal of the flip flop 44 by a line 52 and, by a line 54, to the switch 28. In operation, after the start button 42 has been actuated, a voltage occurs at the output of the integrator 46. The level of the voltage may be preset at the integrator 46. As soon as this voltage has decayed to a value, e.g. zero, which may be preset at the comparator 48, the switch 28 is actuated by way of line 54 to change its condition. Also the flip flop 44 is reset by way of line 52.

If, as depicted in the preffered example, a sensor 38 is utilized and has its output connected to the monitor circuit 40, the output of the monitor 40 may be connected to the set terminal of a further flip flop 56 the reset terminal of which is connected to the output terminal of the comparator 48. The output terminal of the flip flop 56 is connected to a further input terminal of the integrator 46 so that the time constant of the integrator 46 may be changed. As soon as a signal is present at the set input of the flip flop 56, the voltage at the output of the integrator 46 decays more rapidly as indicated by the curve in dashed line.

If the voltage-to-frequency converter 30 is arranged to generate zero frequency at small voltages, and if the reference value of the comparator 48 is below this value, the change in condition of the switch 28 occurs with a small delay relative to the time at which the frequency reaches zero.

The change in time in the voltage generated by the integrator 46 may be programmed in any desired manner. For instance, the voltage may initially be maintained at a constant value corresponding to the resonant frequency of the system before it is allowed to decay. A timing circuit may be utilized to accomplish appropriate programming.

The invention, as will be appreciated by those skilled in the art, is of great utility in controlling the movement of gas exchange valves of internal combustion engines. It may with equal utility be employed to great advantage whereever electric cams or linear motors are required to operate with precision and at small currents. It will be appreciated that changes and modifications may be made to the preferred embodiment without departing from the scope of the invention which is to be determined solely by the claims appended hereto.

What is claimed is:

1. Method of activating an electromagnetic positioning means of the kind comprising a positioning member having an armature affixed thereto, electromagnets for driving the armature between first and second terminal positions, spring means for biasing the armature into a rest position between the first and second terminal positions, and means for energizing the elctromagnets to drive the armature to the terminal positions, the armature together with the positioning member and the spring means constituting an oscillatory system having a predetermined resonant frequency, wherein the method comprises the steps of:

a. alternatingly energizing the electromagnets at a frequency substantially equal to the resonant frequency of the system for a time sufficiently long to activate the positioning means by swinging the armature in oscillating steps toward the first and second terminal positions;

b. maintaining the energizing frequency of the electromagnets during the initial oscillations greater than the resonant frequency of the system;

c. continuously reducing the energizing frequency to zero after the armature has reached a terminal position; and d. thereafter maintaining one of the electromagnets in an energized state.

2. The method of claim 1, wherein the elctromagnets are energized in phase alternation.

3. The method of claim 2, wherein the phase utilization ration of the energizing frequency is about 50%.

4. The method of claim 3, wherein the phases alternate by about 180°.

5. Apparatus for activating an electromagnetic positioning means of the kind comprising a positioning member having an armature affixed thereto, electromagnets for driving the armature between first and second terminal positions, spring means for biasing the armature into a rest position between the first and second terminal positions, and means for energizing the electromagnets to drive the armature to the terminal positions, the armature together with the positioning member and the spring means constituting an oscillatory system having predetermined resonant frequency, wherein the energizing means comprises circuit means for generating a square wave alternating current signal of variable frequency.

6. The apparatus of claim 5, further comprising a steering circuit means for activating the electromagnets in accordance with the sqare wave alternating current signal.

7. The apparatus of claim 5, wherein the energizing means further comprises means for generating a direct voltage signal of variable amplitude.

8. The apparatus of claim 5, wherein the energizing means further comprises a voltage-to-frequency converter.

9. The apparatus of claim 7, further comprising a voltage-to-frequency converter.

10. The apparatus pf claim 5, further comprising switch means controlled by the energizing means for connecting the steering circuit with a control circuit when the variable frequency has reached a predetermined value.

11. The apparatus of claim 5, further comprising sensor means for sensing the position of the positioning member and for generating a signal representative of the positioning member being in a terminal position and means for feeding the sonsor signal to the energizing circuit means for inducing a reduction in frequency.

12. The apparatus of claim 11, wherein the sensor comprises an induction coil connected to an input of either electromagnet and responsive to a change of current flowing therein.

13. The apparatus of claim 5, wherein the positioning member comprises a valve stem of a valve of an internal combustion engine.

* * * * *